United States Patent [19]

Gaia et al.

[11] Patent Number: 4,771,259

[45] Date of Patent: Sep. 13, 1988

[54] ELECTRIC PROTECTIVE DEVICE AND METHOD FOR MANUFACTURING SAME

[75] Inventors: Aldino J. Gaia, St. Louis; Donald E. Johnston, Ellisville, both of Mo.

[73] Assignee: Cooper Industries, Inc., Houston, Tex.

[21] Appl. No.: 78,863

[22] Filed: Jul. 28, 1987

[51] Int. Cl.[4] ..... H01H 85/04

[52] U.S. Cl. ..... 337/165; 337/163

[58] Field of Search ..... 337/163, 164, 165, 166, 337/265, 231, 260, 255, 239, 261; 338/232, 233; 29/623

[56] References Cited

U.S. PATENT DOCUMENTS

| | | | |
|---|---|---|---|
| 2,111,749 | 3/1938 | Busmann | 337/165 |
| 2,210,036 | 8/1940 | McEntee | 337/261 |
| 2,296,923 | 9/1942 | Hansen | 177/232 |
| 2,342,310 | 2/1944 | Taylor | 337/165 |
| 4,562,420 | 12/1985 | Kowalik et al. | 337/165 |

*Primary Examiner*—H. Broome

*Attorney, Agent, or Firm*—Dodge, Bush & Moseley

[57] ABSTRACT

A connecting apparatus for connecting one end of a spring of a time-delay fuse to a hollow body of the fuse and a method for its manufacture is disclosed. The apparatus includes two transverse slots formed in the end of the body. An insert is placed in the slots. A central portion of the insert is disposed in the interior of the hollow body. An opening, such as one or more slots, is provided in the central portion of the insert for attaching one end of a spring to the insert and the body of the fuse. The other end of the spring is adapted to connect to a fusible element of the time-delay fuse. The method of manufacture of the apparatus includes forming transverse slots in the end of a hollow tube, placing the insert in the slots, and attaching one end of the spring to an opening in the insert. An alternative method of manufacture includes molding the hollow tube with an integral transverse member across the end of the tube, the transverse member having an opening in it. The spring of the time-delay fuse is then connected to the opening of the transverse member as a step in fabricating the fuse.

11 Claims, 1 Drawing Sheet

FIG. 1
(PRIOR ART)
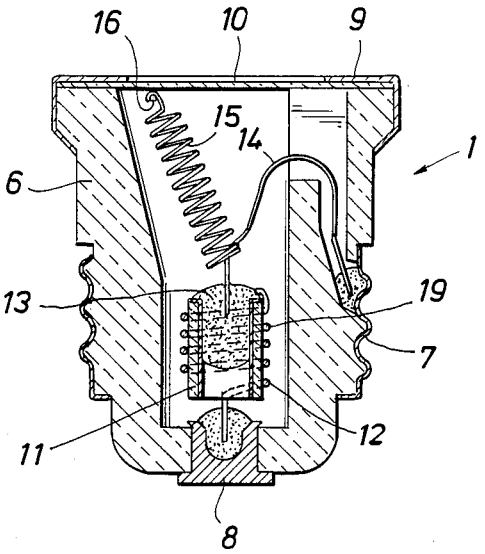
FIG. 2
(PRIOR ART)
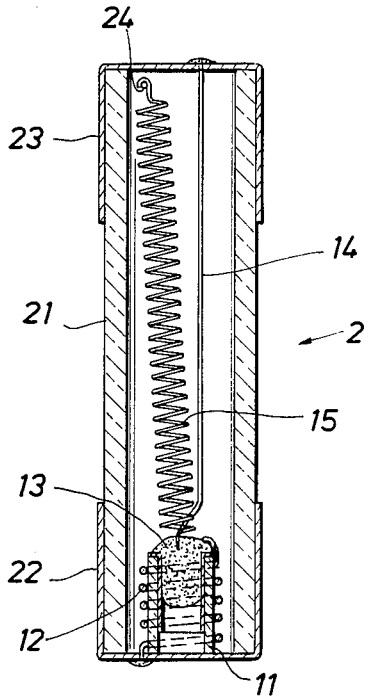
FIG. 3
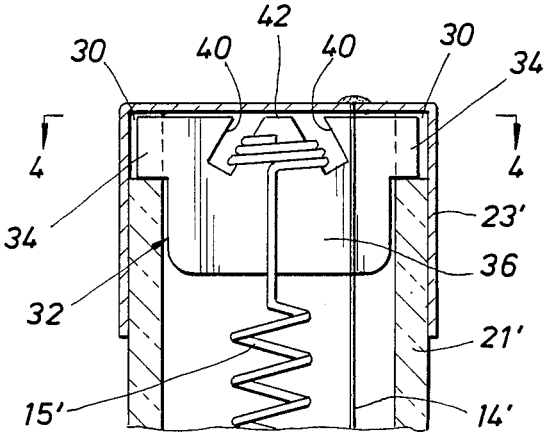
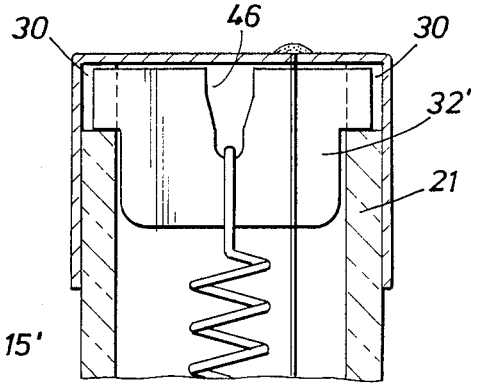
FIG. 5
FIG. 4
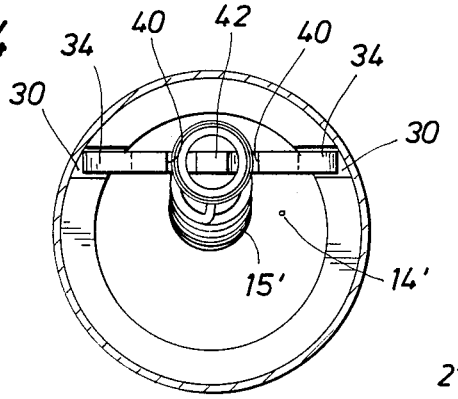
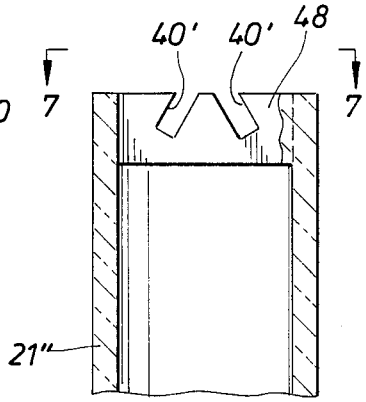
FIG. 6
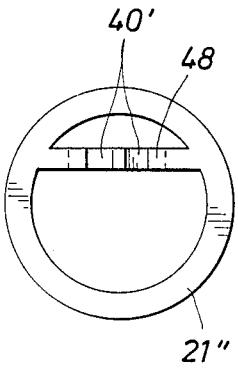
FIG. 7

ELECTRIC PROTECTIVE DEVICE AND METHOD FOR MANUFACTURING SAME

BACKGROUND OF THE INVENTION

1. Field of the Invention

This invention relates in general to fuses for protecting electric circuits and in particular to time-delay fuses and methods for their manufacture.

2. Description of the Prior Art

Time delay fuses are designed such that when current through them exceeds the rating of the fuse for a predetermined time, heat will in time be generated and conducted to a fusible plug. The heat causes the plug to soften and create an open circuit through the action of a spring connected to it at one end tending to pull the plug away from a connection in the fuse. The other end of the spring is attached to the body of the fuse. One example of such fuses is presented in U.S. Pat. No. 2,111,749 to Bussman issued Mar. 22, 1938 which shows a combined time-delay and ordinary high current fuse in both cartridge type and plug type configurations.

Another example of such fuses is presented in U.S. Pat. No. 2,210,036 to McEntee issued Aug. 6, 1940. Yet another example of such fuses is shown in U.S. Pat. No. 2,342,310 to Taylor. A disadvantage of such prior art fuses has been in the connection of the spring to the fuse body so as to maintain the connection of the spring to the body at a point within the cylindrical body. Such cylindrical bodies are typically constructed of brittle or non-malleable insulating materials such as thermosets, melamines, ceramics, glass epoxies and the like which are difficult to notch, bend or punch. The art has searched for a connection structure which may be economically manufactured using such materials.

IDENTIFICATION OF OBJECTS OF THE INVENTION

A general object of this invention is to provide improved structure for connecting an end of the spring to the body from a point within the interior of the body and which will maintain the connection to that point under conditions of vibration and shock to the body.

Another object of the invention is to provide an improved method for manufacturing the improved structure for connecting an end of the spring to the body of a time-delay fuse.

SUMMARY

The objects identified above as well as other advantages and features are incorporated in an improved structure for connecting one end of a spring of a time-delay fuse to a generally cylindrical fuse body. Two transverse slots are formed in the end of the cylindrical body. An insert is placed in the slots, the insert having a central portion disposed in the interior of the body. An opening is formed in the central portion of the insert for attaching the end of the spring to the insert and the body of the fuse. The opening may be a slot for securing the end spring of the spring to the insert. Two slots may be provided in the insert separated by a central neck about which the end of the spring may be securely wrapped.

A method of manufacturing the apparatus according to the invention includes the step of molding the body of the fuse of non-malleable material with transverse slots in its end. The spring is attached to the opening of the insert, and the insert is inserted in the slots during fabrication of the time-delay fuse. Alternatively, the generally cylindrical fuse body may be molded integrally with the connecting member similar in shape to the separate piece insert described above and is disposed with the interior of the body. The molding step includes providing an opening such as one or more slots in the insert member.

BRIEF DESCRIPTION OF THE DRAWINGS

The invention summarized above is illustrated in the accompanying drawing of which:

FIG. 1 illustrates in cross-section a prior art plug type time-delay fuse in combination with an ordinary fuse element in which one end of a spring is connected to a fusible plug and at the other end to the fuse body;

FIG. 2 illustrates in cross-section a prior art combination similar to that of FIG. 1 but of a cartridge type;

FIG. 3 is a cross-sectional view of a time-delay fuse illustrating the connection of the plug spring to the generally cylindrical body of the time-delay fuse according to the invention;

FIG. 4 is a plan view of the connection of the plug spring to the cylindrical body of the fuse according to the invention;

FIG. 5 is an illustration of an alternative opening arrangement in the insert for connecting the end of the plug spring to the body of the fuse; and FIGS. 6 and 7 are cross-sectional and plan views respectively of the end of a time-delay fuse illustrating a body and connecting member manufactured by integrally molding the body and connecting member.

DESCRIPTION OF THE INVENTION

FIGS. 1 and 2 illustrate prior time-delay fuses with conventional fuse links disclosed in U.S. Pat. No. 2,111,749 which is incorporated herein for all purposes. FIG. 1 illustrates a plug type fuse; FIG. 2 illustrates a cartridge type fuse.

The plug type fuse of FIG. 1 includes a body 6 of insulation material on which are carried contacts comprising screw shell 7 and center contact 8. A top cap 9 in combination which disk 10 serves as a closure for the device. Heat coil or resistance element 11 includes a resistance wire 12 wound thereon serving as a heat coil. Wire 12 is electrically connected to center contact 8. Plug 13 is a quantity of low melting point solder or fusible material held within heat coil unit 11 and connected to the wire 12. Fuse link 14 is connected to the plug 13 at one end and to the screw contact 7 at its other end. Spring 15 is attached to the fuse link 14 near the plug 13. Bar 16 is seated in transverse slots or grooves of the end of the body. The end of the spring 15 is simply hooked about the bar 16 and under conditions of shock or vibration to the fuse body may not remain centered within the interior of body 6.

FIG. 2 is a cross-sectional view of a prior art cartridge type time-delay fuse. Body 21 is a tube of insulation material to which contacts 22 and 23 are attached by conventional means. The heat coil 11, resistance wire 12, and fuse link 14 correspond to those of FIG. 1. Spring 15 is attached to bar 24 in a similar way as spring 15 is hooked to the bar 16 of FIG. 16.

The fuse link 14 in either of these types may be a one piece fuse wire or strip or a multiple of them or it may be a fuse wire or strip with terminals of other or same material attached at one or both ends. The link 14 may also be a single electrical conductor, not designed to blow during high current conditions.

As indicated above, the fuse link may, if desired, be constructed to blow out under high current conditions. For example in a 5 ampere protector the link used might be such as would ordinarily be used in a 15 ampere fuse. The fuse link, however, is not depended on to determine the rating of the protector but can be designed to blow only on extremely heavy overloads or short circuits. The heat coil is so designed that when the current exceeds that for which a protector of this kind is designed, sufficient heat will in time be generated and conducted to the holding means or plug 13 to cause it to soften or release its hold. As soon as this happens, the spring pulls out the end of the fuse strip and thereby opens the circuit. On extremely heavy overloads or short circuits the fuse link can be designed to fuse and open the circuit before sufficient heat has been conducted to the solder 13 to soften or melt it.

FIGS. 3 and 4 show an improved apparatus for connecting the spring 15' to body 21' according to the invention. Although illustrated for a cartridge type body, the invention is directed to connecting the spring 15 to any generally cylindrical insulating body such as that of a time-delay fuse 1 of FIG. 1.

The generally cylindrical body 21' includes transverse slots 30 formed in its end. An insert 32 having shoulders 34 and a central portion 36 fits into the interior of the body 21'. Slots 30 of the body 21' support shoulders 34. The central portion 36 is sized to be self centering within the interior of body 21'. Contacts 23' close the body 21' and maintains the insert 36 within slots 30.

FIGS. 3 and 4 illustrate an opening in insert 36 including angles slots 40 separated by a neck 42. The end of spring 15' is connected to insert 32 by wrapping it about neck 42 within slots 40. The construction of FIGS. 3 and 4 is advantageous as compared to prior art constructions of FIGS. 1 and 2 in that the end of spring 15' is assured of maintaining its fixed position to neck 42 of insert 36 under conditions of extreme shock and vibration. The insert 32 is relatively strong compared to prior art bars 16 or 24 and is designed to be self-centering within body 21' by virtue of the central portion 36 having sides which closely fit within the walls of body 22' while being supported within body slots 30 by shoulder 34.

The insert 32' of FIG. 5 is similar to insert of 32 of FIGS. 3 and 4 except that the opening in it for attaching spring 15 is a Vee-shaped notch 46.

The structures of FIGS. 3 and 5 are advantageous from a manufacturing point of view in that the body 32 may be of brittle or non-malleable materials such as thermosets, melamines, ceramics, glass epoxies and the like. Such materials are relatively difficult to form as by punching, notching or bending. On the other hand, such materials may be molded in the form of a cylindrical body 21' with slots 30 as illustrated in FIGS. 3, 4, and 5. Molding body 21' with slots 30 formed therein is the preferred method of manufacturing the structures of FIGS. 3 and 5. The end of spring 15'; is secured within openings 40 or 46 of inserts 32 or 32'. The inserts are then placed within slots 30 during the manufacture of the time-delay fuse.

FIGS. 6 and 7 illustrate cross-sectional and plan views of an integral member 48 and cylindrical body 21''. An opening in member 48 may comprise angled notches 40' similar to those of FIG. 3. The integral structure of FIGS. 6 and 6 is manufactured by molding the body 21'' and insert 48 as a single structure. The spring 15' is attached to an opening such as notches 40' during the fabrication of the time-delay fuse.

While several forms or embodiments of the inventive structure and methods for their manufacture have been illustrated and described, various modifications of structure and manufacture will be apparent to those of skill in the time-delay fuse art. For example, the opening of inserts 32, 32' or 48 may be a simple hole through which the end of the spring 15' may be hooked. These modifications can be made without departing from the spirit of the invention.

What is claimed is:

1. In a protector for an electrical circuit having a tubular body of insulation material and having electrical contacts mounted thereon, said tubular body enclosing a resistance element to heat a fusible material by softening it when a current of predetermined magnitude flows through said resistance element, said fusible material being in electrical circuit with said electrical contacts, and a spring with means connecting said spring to said fusible material at a first end of said spring and to said body at its second end, said spring being adapted to open the electrical circuit when said fusible material becomes softened by heat generated by said resistance element, an improved connecting structure to connect the second end of said spring to the body comprising, an insert affixed in the end of said tubular body having at least one opening means formed therein for securing said second end of said sping to said insert in the interior of said tubular body.

2. The improved connecting structure of claim 1 wherein said tubular body end includes two transverse slots, and said insert is placed in said slots of said tubular body end.

3. The improved connecting structure of claim 1 wherein said opening means of said insert includes two notches separated by a neck member, and said second end of said spring is placed about said neck member in said two notches.

4. The structure of claim 1 wherein said notches are formed in an end of said insert.

5. The improved connecting structure of claim 1 wherein said opening means of said insert includes a notch, and said second end of said spring is hooked in said notch.

6. The structure of claim 5 wherein said notch is Vee-shaped formed in an end of said insert.

7. Connecting apparatus connecting one end of a spring of a time-delay fuse to a generally hollow body of the fuse comprising, two transverse slots formed in the end of said hollow body, an insert placed in said slots, said insert having a central portion disposed in the interior of said hollow body, and opening means formed in said central portion of said insert attaching an end of said spring to said insert.

8. The apparatus of claim 7 wherein said opening means includes a notch formed in an end of said insert.

9. The apparatus of claim 7 wherein said opening means includes two notches formed in an end of said insert separated by a neck member.

10. The apparatus of claim 7 wherein said hollow body is tubular in shape.

11. The apparatus of claim 7 wherein said hollow body is of plug shape.

* * * * *